United States Patent [19]

Gibson

[11] 4,198,641

[45] Apr. 15, 1980

[54] ROTATING FIELD POLARIZATION ANTENNA SYSTEM

[75] Inventor: John J. Gibson, Princeton, N.J.

[73] Assignee: RCA Corporation, New York, N.Y.

[21] Appl. No.: 768,592

[22] Filed: Feb. 14, 1977

[30] Foreign Application Priority Data

Aug. 9, 1976 [GB] United Kingdom ..... 33117/76

[51] Int. Cl.[2] ..... H01Q 21/26

[52] U.S. Cl. ..... 343/797; 343/100 PE; 343/853

[58] Field of Search ..... 343/756, 797, 100 PE, 343/853, 200; 325/56, 368–371

[56] References Cited

U.S. PATENT DOCUMENTS

| | | | |
|---|---|---|---|
| 2,374,271 | 4/1945 | Brown | 343/798 |
| 3,093,824 | 6/1963 | Ammerman | 343/756 |
| 3,725,943 | 4/1973 | Spanos | 343/797 |
| 4,051,474 | 9/1977 | Mack | 343/756 |

*Primary Examiner*—Eli Lieberman

*Attorney, Agent, or Firm*—Eugene M. Whitacre; Paul J. Rasmussen; Robert L. Troike

[57] ABSTRACT

An antenna system particularly suitable for permitting low cost reception of broadcasted circularly polarized television low and high VHF signals is provided by arranging all of the broadcast antennas so that the low and high VHF television frequency signal waves are radiated in opposite directional senses of circular or elliptical polarization. The low cost receiving antenna for receiving both of these bands comprises a pair of linear elements with the first of the pair of elements adapted to receive linearly polarized waves in a first linear polarization and a second of the elements adapted to receive linearly polarized waves in a second orthogonal polarization. A combining means includinga delay is provided for combining the signal waves received at one of the pair of elements with delayed signal waves received at the other of the receiving elements where the delay is on the order of one-quarter wavelength at a frequency within the low VHF frequency band.

7 Claims, 7 Drawing Figures

ROTATING FIELD POLARIZATION ANTENNA SYSTEM

BACKGROUND OF THE INVENTION

This invention relates to antennas and, more particularly, to a system for transmitting and receiving circularly or elliptically polarized waves and a method for receiving such waves over two widely spaced frequency bands.

At the present time, the FCC (Federal Communications Commission) is considering broadcasting television signals in circular polarization. It has been suggested that improved television reception in large metropolitan areas can be achieved even though the reception antennas are arranged to receive horizontal polarization.

The real advantages, however, of a circularly polarized antenna system can be realized with circularly polarized receiving antennas. It is a well established phenomenon that reflected circularly polarized waves from objects located in the main reception direction such as a building appears at the receiving antenna reversed in rotation. Therefore, it would be possible to reject reflected waves of reversed polarization rotation from the main wave by having a receiving antenna in which the polarization is designed to match the polarization rotation direction of the transmitted wave. For example, a receiving antenna designed to match a right circularly polarized broadcasting wave will be isolated from the reflected waves from the same direction which would appear left circularly polarized.

In the recent tests for circular polarization for broadcasting television, the type of circularly polarized receiving antennas used have been crossed dipoles fed in phase quadrature. This quadrature phasing is provided, for example, by a delay line wherein the feed line length to one of the dipoles in one-quarter wavelength longer than the feed line length to the other dipole where the one-quarter wavelength is measured at the center of the broadcast frequency band. Although this system operates well for a given frequency band, the receiving antenna is frequency limited and as such would not operate to provide reception of, for example, right circularly polarized waves over both the low and high VHF television frequency bands. The system planned, therefore, would require a separate antenna for each of the bands if one were to receive both high and low VHF television frequency bands.

SUMMARY OF THE INVENTION

An antenna system for communicating circular or elliptically polarized signal waves over two separate frequency bands where one frequency band contains a frequency approximately three times the other frequency band using a common receiving antenna is provided. This antenna system includes means for radiating said one frequency band signals in a first rotational directional sense and means for radiating the other frequency band signals in a rotational directional sense opposite the first sense. The receiving antenna located in the common coverage area comprises a single antenna means adapted to receive in the direction of the radiating means said one frequency band signals only in a first rotational directional sense and the other frequency band signals in only said opposite rotational directional sense.

DESCRIPTION OF THE INVENTION

Figure 1:
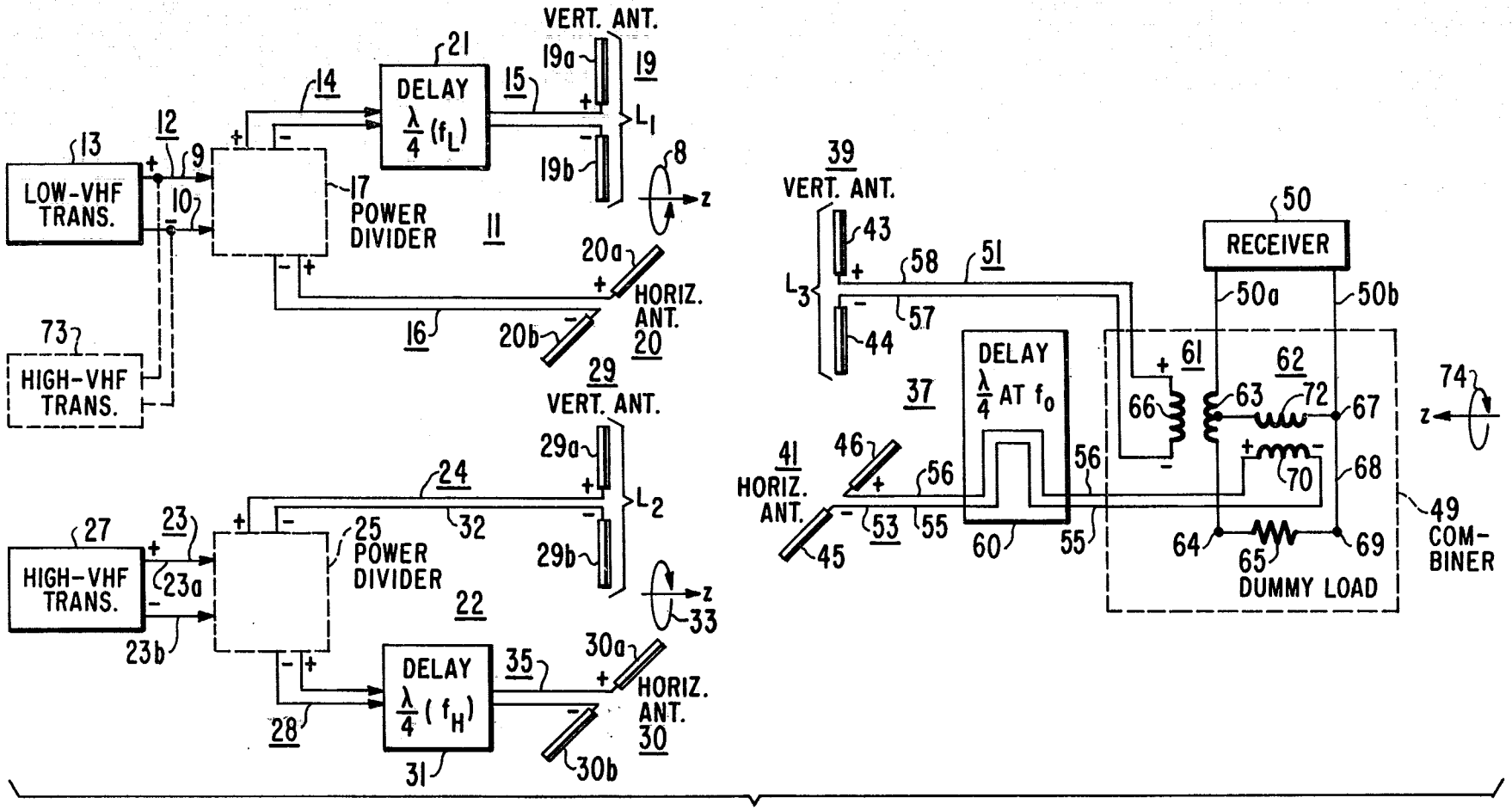
FIG. 1 is a sketch illustrating an antenna system for permitting low cost reception of all circularly polarized VHF television frequency waves according to one embodiment of the present invention.

Television in the United States is broadcasted over three separate bands: the UHF, the high band VHF and the low band VHF television frequency bands. The two most widely used television frequency bands for commercial broadcasting are the high VHF and the low VHF television frequency bands. The low VHF television frequency bands extend from 54 $MH_z$–88 $MH_z$ (channels 2 thru 6) and the high VHF band extends between 174–216 $MH_z$ (channels 7 thru 13). The center frequency of the high VHF band is approximately three times the center frequency of the low VHF band.

Referring to FIG. 1, there is illustrated an antenna system for broadcasting circularly polarized high and low VHF television frequency signals and a single simple receiving antenna system for receiving all of these signals. The low VHF signals are transmitted via broadcast antenna subsystem 11 and the high VHF signals are transmitted via broadcast antenna subsystem 22. The receiving antenna subsystem 37 is designed to receive signal waves from both broadcast antennas while rejecting reflected signal waves from both broadcast antennas. According to a teaching herein, all of the low VHF television frequency band signals would be transmitted using broadcast antennas that transmit circularly polarized waves in the opposite directional sense to all of the circularly polarized broadcast signal waves from the broadcast antennas operating the high VHF television frequency bands. For example, antenna system 11 transmits low VHF television frequency band signals that rotate right circular polarization from the antenna 11. This is indicated by a directional arrow 8 in FIG. 1. A right circularly polarized wave appears to rotate clockwise from the transmitting antenna and appears to rotate counterclockwise at the receiving antenna 37 or with respect to an approaching wave. The signals from the low VHF transmitter 13 are coupled via two conductor transmission line 12 to power divider 17. The signals from the low VHF transmitter 13 at power divider 17 are power divided with half power signals coupled via two conductor transmission line sections 14 and 15 and delay 21 to vertical dipole 19. The power divided signals at the power divider 17 are also coupled via two wire transmission line 16 to horizontal dipole 20. When the transmitter 13 provides the polarities "+"

and "−" at conductors 9 and 10, respectively, of transmission line 12, the antenna elements have the polarities indicated at elements 19*a*, 19*b*, 20*a* and 20*b*. The dipoles 19 and 20 are for example to be of a length $L_1$ one-half wavelength long at the transmitted video carrier frequency and are impedance matched to the transmission lines. The phase of the signal coupled to the vertical dipole 19 is delayed approximately 90° relative to the phase of the signal applied to the horizontal dipole 20 by means of the delay 21. The delay 21 is selected so as to be for example one-quarter wavelength long at the center operating frequency ($\lambda/4$ at $f_L$) of the low VHF transmitter 13. This delay 21 may be achieved for example by the sections 14 and 15 being together one-quarter wavelength longer at this center frequency than section 16. Although this antenna system 11 is illustrated as a pair of orthogonal dipoles to achieve circularly polarized signals, many other types of antennas well known in the art may be provided for achieving the desired broadcast antenna. The antenna may be a broadcast tetrahelical antenna similar to that described by Ben-Dov in U.S. Pat. No. 3,940,772, where the pitch angle of the helices and the phasing is such as to broadcast broadside a support tower right (direction of arrow 8 in FIG. 1) circularly polarized signals. Other forms of broadcast antennas for producing circular polarization may be found, for example, in U.S. Pat. No. 3,943,522 of Ben Dov, U.S. Pat. No. 3,932,876 of Ben Dov, and U.S. Pat. No. 3,906,509 of DuHammel.

A high VHF transmitting antenna system 22 similar to that described above in connection with antenna system 11 is also provided but it is designed to transmit the high VHF television frequency band signals in a left circularly polarized mode where the field rotates in a counterclockwise direction from the transmitting antenna system 22 as indicated by arrow 33. This signal wave appears at the receiving antenna 37 as a wave that rotates in a clockwise direction. The antenna system 22, for example, may include a power divider 25 coupled to a high VHF frequency band transmitter 27 with half of the power being applied to the vertical dipole 29 and half of the power being applied via a delay 31 to the horizontal dipole 30. The signals from the high VHF transmitter 27 are coupled via two conductor transmission line 23 to a power divider 25. These signals at power divider 25 are applied to vertical dipole 29 via transmission line 24 and to horizontal dipole 30 via two wire transmission line sections 28 and 35 and delay 31 with half of the power coupled to the vertical dipole 29 and half of the power coupled to the horizontal dipole 30. When the tramsmitter provides the polarities indicated "+" and "−" on conductors 23*a* and 23*b* respectively, of transmission line 23, the antenna elements have the polarities indicated at elements 29*a*, 29*b* and 30*a* and 30*b*. The dipoles 29 and 30 are designed for example to be of a length $L_2$ one-half wavelength long at transmitted high VHF video carrier frequency. In this case, the extra delay is provided by delay 31 in the feed line at the horizontal dipole 30. The delay 31 provides approximately one-quarter wavelength delay at a frequency $f_H$ which for example is the center frequency $f_H$ of the transmitted high VHF frequency band. This frequency $f_H$ may also be the transmitted video carrier frequency. The antenna system 22 may be like any one of the types of antennas described above in connection with antenna 11, but arranged so as to produce a left (indicated by arrow 33 in FIG. 1) circularly polarized wave from the transmitting antenna.

The receiving antenna 37 operating in the overlapping area or zone of these two broadcast antenna systems 11 and 22 comprises a pair of orthogonally crossed dipoles 39 and 41 with dipole 39 extending for example vertically and comprising elements 43 and 44 and with dipole 41 extending horizontal and comprising elements 45 and 46. The pair of dipole elements 43 and 44 and the pair of dipole elements 45 and 46 each being of a combined length $L_3$ for example to be half wave resonant at a frequency near the center of the low VHF frequency band. The dipoles 39 and 41 are fed to an additive combiner 49 over separate parallel transmission lines 51 and 53. The output of the combiner 49 is coupled via leads 50*a* and 50*b* to a common receiver 50. The transmission line 51 is, for example, a parallel transmission line with conductor 57 coupled to vertical dipole element 44 and conductor 58 coupled to vertical dipole element 43. The transmission line 53 is a parallel transmission line with conductor 55 coupled to horizontal dipole element 45 and conductor 56 coupled to horizontal dipole element 46. Transmission line 53 is one-quarter wavelength at a frequency $f_o$ near the center of the low VHF band longer than the length of line 51 to provide a delay 60 at the low VHF frequency band. The extra length of transmission line 53 provides at the coupler 49 for the low VHF television frequency band approximately a 90° relative phase shift between the two dipoles 39 and 41. This same section of line (delay 60) is three-quarter wavelengths long ($3\lambda/4$) at a frequency close to the center of the high VHF television frequency band since the high VHF band is approximately three times the center frequency $f_o$ of the low VHF television frequency band. Therefore, this delay 60 provides approximately 270° relative phase shift or a −90° relative phase shift between the two dipoles 39 and 41 in the high VHF frequency band.

In the combiner 49 are a pair of transformers 61 and 62 with the secondary coil 63 of transformer 61 connected between lead 50*a* and terminal 64 of a dummy load 65. The primary 66 of transformer 61 is connected between lines 57 and 58. The secondary 72 of transformer 62 is connected between a center tap of secondary coil 63 and junction point 67 of lead 50*b* coupled to receiver 50 and lead 68 connected to terminal 69 of the dummy load 65. The primary coil 70 of transformer 62 is connected to antenna leads 55 and 56.

In the operation of the receiving antenna 37, the right circularly polarized signals from the antenna system 11 are coupled at the dipole elements 39 and 41 and are added in phase at the combiner 49 and coupled to receiver 50. If the delay 60 in antenna system 37 is one-quarter wavelength long at the same low VHF transmitter frequency as sent from antenna system 11, maximum coupling to the receiver of these right circularly polarized signals is provided. This occurs because there is identical delay in delays 21 and 60 at this low VHF frequency. Therefore, both vertically polarized signals via delay 21 and the horizontally polarized signals via delay 60 undergo basically identical one-quarter wavelength delay and the signals are added in phase at combiner 49. If the antenna system 37 is selected such that the delay 60 is one-quarter wavelength at approximately a mid low VHF frequency, there is coupling of all signals that are right (direction of arrow 8) circularly polarized (counterclockwise as viewed at the receiving antenna) in the low VHF television frequency band to the receiver 50 with maximum signal coupling at the middle of the low VHF frequency band. In the particular operation of the antenna shown in FIG. 1 and for the polarities indicated in connection with transmitting antenna system 11, the horizontal dipole element 41 receives the horizontally polarized wave from antenna 20 with the polarities indicated with a "+" at element 46 and a "−" at element 45. This signal is delayed via delay 60 and applied to primary 70 of transformer 62 with the polarity indicated. The signal radiated from vertical antenna 19 is received at dipole 39 with the polarity at element 43 being "+" and the polarity at element 44 being a "−". The signals from the vertical antenna 39 are applied across coil 66 of transformer 61 and are applied in phase with the delayed signal from the horizontal element. However, low VHF frequency signals rotating in an opposite direction (clockwise direction as viewed at the receiving antenna) are out of phase at the low VHF frequency band since the signal received at the vertical antenna is already 90° out of phase with the horizontal antenna and by the addition of the one-quarter wave delay 60 makes these signals 180° out of phase at the combiner cancelling these signals to the receiver 50. When the signals are rotating in this wrong clockwise direction as viewed at the receiving antenna, the polarity at element 43 becomes "−" with respect to the polarity at element 44 at the time the horizontal signals are applied across coil 70. Since the polarity is reversed, signals are now out of phase at the coupler receiver terminals and hence cancel at the receiver termination and add at the dummy load termination. Therefore, this antenna system 37 is responsive only to low VHF band right circularly polarized signals to provide signals to the receiver 50. At the high VHF frequencies, the delay 60 is a three-quarter wavelengths long. This delay therefore adds an extra 180° to provide a 270° phase difference between the vertical antenna and the horizontal antenna. This is equivalent to a −90° phase difference and therefore this same antenna system 37 provides reception of high VHF transmitter frequency signal waves that are left circularly polarized or rotating clockwise as viewed at the receiving antenna. Obviously, the maximum reception at the high VHF transmitter frequency band is achieved at that frequency in which the delay 60 is exactly three-quarter wavelengths long. As can be seen viewing FIG. 1, the signal from the transmitter 27 via horizontal dipole 30 undergoes 90° through delay 31 and 270° through delay 60. An extra of 360° phase delay takes place in the path from power divider 25 to combiner 49 through horizontal antennas 30 and 41 and delay 60 compared to the path through vertical dipoles 29 and 39. These left circularly polarized signals are in phase at the combiner 49 receiver terminals. However, right circularly polarized signals at the high VHF television frequency band in the opposite or counterclockwise rotational sense as viewed at the receiving antenna, are out of phase at the combiner receiver terminals and hence cancel. The operation of the receiving antenna 37 is further discussed in connection with FIG. 2.

Figure 2:
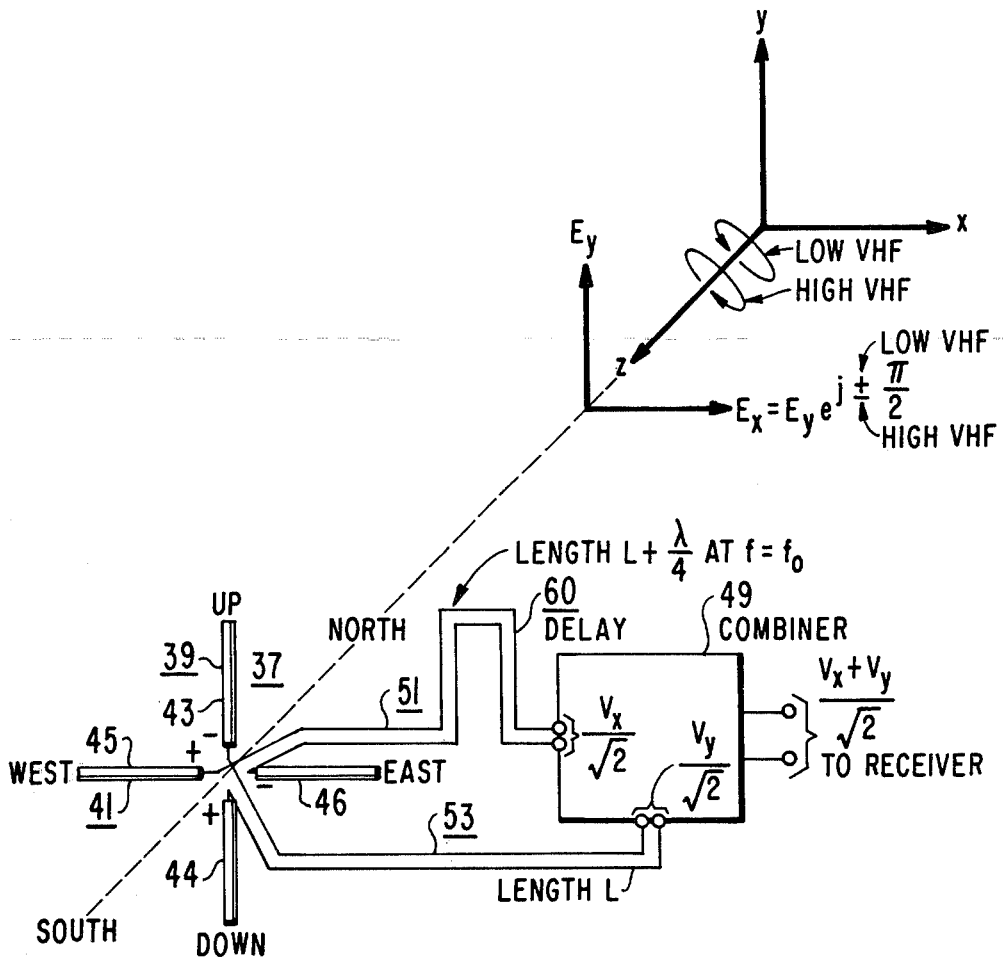
FIG. 2 is a coordinate system useful in explaining the operation of the receiving antenna in the system of FIG. 1.

Referring to FIG. 2, a right hand corrdinate system xyz defines the polarization and phase of the electromagnetic field with the antenna discussed above. The vertical electric field y direction establishes a reference phase and can be expressed by the electric field component $$E_y = E_o e^{j\omega t}$$

The horizontal field (x-direction), pointing toward the right is advanced 90° in the low VHF and retarded 90° in the high VHF $$E_x = E_o e^{j(\omega t + \pi/2)} \quad \text{low VHF}$$

$$E_x = E_o e^{j(\omega t - \pi/2)} \quad \text{high VHF}$$

The z direction is the direction of propagation. This difference between the electric lengths of the transmission lines 51 and 53 is one-quarter of wavelength at a frequency $f_o$, which is approximately near the middle of the low VHF band. The added phase shift in the horizontal line is thus $(\pi/2)\ (f/f_o)$ = phase shift in horizontal line relative to vertical line and f is the frequency of the received wave.

The input voltage to the combiner is $V_y$ from the vertical antenna, and from the horizontal antenna is $$\begin{cases} V_x = V_y e^{j\frac{\pi}{2}(1 - f/f_o)} & \text{low VHF} \\ V_x = V_y e^{-j\frac{\pi}{2}(1 + f/f_o)} & \text{high VHF} \end{cases}$$

The output voltage of the combiner, feeding the receiver, is $$V = (V_x + V_y)/\sqrt{2}$$

If $$V_x = V_y e^{j\phi}$$

then the input voltage is $$V = e^{i\phi/2}\sqrt{2}\ V \cos \phi/2$$

or $$|V| = V_{max} |\cos \phi/2|$$

where $$V_{max} = |V_y|\sqrt{2}$$

Thus $$|V| = V_{max} |\cos (\pi/4)(1 - f/f_o)| \quad \text{at low VHF}$$

$$|V| = V_{max} |\cos (\pi/4)(1 + f/f_o)| \quad \text{at high VHF}$$

An optimum choice of $f_o$ turns out to be 65.5 $MH_z$ which is close to the center frequency in the low VHF band. At this frequency $|V|$ is obviously equal to $V_{max}$. At $3f_o = 196.5$, a frequency approximately in the middle of the high VHF band, the output is again $|V| = V_{max}$. At other frequencies in the VHF band the output relative to $V_{max}$ is as shown in Table I.

TABLE I

| Freq. f | $\lvert V\rvert/V_{max}$ | dB loss |
|---|---|---|
| 54 | .9905 | .08 |
| 65.5 | 1.000 | 0 |
| 88 | .9638 | .32 |
| 174 | .9638 | .32 |
| 196.5 | 1.000 | 0 |

TABLE I-continued

| Freq. f | $\lvert V\rvert/V_{max}$ | dB loss |
|---|---|---|
| 216 | .9727 | .24 |

Thus, with this simple antenna system the maximum loss is less than ⅓ dB. The choice of $f_o$ is determined by the highest low VHF frequency (88 MHz) and the lowest high VHF frequency (174 MHz), $f_o=(88+174)/4=65.5$. (Obviously, the frequency may be 2 to 3 MHz on either side of the 65.5). Reflected signals or "ghost" tend, at least in a theory with simplifying assumptions, to be circularly polarized waves rotating in the wrong direction. A ghost coming from the same direction as the transmitter will then yield input voltages to the receiver $$|V|/V_{max} = \begin{cases} \cos\frac{\pi}{4}(1+f/f_o) & \text{Low VHF} \\ \cos\frac{\pi}{4}(1-f/f_o) & \text{High VHF} \end{cases}$$

The "ghost" rejection is shown in Table II below.

TABLE II

| Freq. | $\lvert V\rvert/V_{max}$ | Ghost Rejection dB |
|---|---|---|
| 54 | 0.137 | −17 |
| 65.5 | 0 | −∞ |
| 88 | 0.266 | −11.5 |
| 174 | 0.266 | −11.5 |
| 196.5 | 0 | −∞ |
| 216 | 0.2316 | −12.7 |

Also the antenna system 37 would see the low VHF right circularly polarized signals coming from a transmitter in the direction of arrow Z' as rotating in the wrong direction as indicated by arrow 74 in FIG. 1. Signals transmitted from a low VHF transmitter to the rear appear to the receiving antenna system 37 as rotating clockwise. Therefore, the antenna system 37 would reject these co-channel signals coming from the rear of the antenna system 37. Similar results are achieved at the high VHF band.

Improved "ghost" rejection can be provided by using basically the same type of antenna system as in system 11 of FIG. 1 for broadcasting all high and low VHF television channels with the delay 21 for all channels set to be one-quarter wavelength delay at the operating frequency of 65.5 MHz or near the center of the low VHF television frequency band. The length of the dipoles would be adjusted to fit the particular channel frequency. The delay 60 in receiving antenna 37 for such a system would be identical with delay 21 or set at $\lambda/4$ at 65.5 MHz. In this system and at this low VHF frequency of 65.5 MHz, the transmitted signal is circularly polarized in the right circularly polarized sense as indicated by arrow 8. The high VHF transmitters are coupled to this same type of antenna system 11 as indicated by dashed lines 73. If this high VHF transmitted signal is at 196.5 MHz (3×65.5), this delay 21 would provide three-quarters of a wavelength delay at this frequency and the antenna system 11 would consequently radiate left circularly polarized signals or clockwise radiated as viewed at the receiving antenna. At all of the other transmitted frequencies, the antenna system 11 would transmit elliptically polarized waves with the degree of ellipticity depending on the frequency deviation from these two frequencies. The delay in the circuit 21 for the low VHF frequencies would be equal to $\pi/2$ $(f/f_o)$where $f_o$ is at 65.5 MHz and f is the frequency being transmitted and the sense of polarization would be right elliptically polarized (direction of arrow 8). The delay in the circuit 21 for the high VHF would be equal to $\pi/2$ $(f/f_o)$, where the sense of polarization (direction) would be reversed (left elliptically polarized in the direction of arrow 33). Further, at these other frequencies, the major and minor axis of the ellipse are at a 45° with respect to the vertical. The ellipticity of the radiated field is determined by the vertical and horizontal field components, $$E_y=E_o\cos(\omega t-\phi/2)$$

$$E_x=E_o\cos(\omega t+\phi/2)$$

where $\phi$ is the phase delay of the vertical component with respect to the horizontal. This ellipticity can be determined by the following equation and described in the following Table III:

$$\epsilon=\tan\phi/2=\tan((\pi/4)f/f_o)$$

wherein $\epsilon$ is ellipticity and angle in radians

TABLE III

| Frequency MHz | Ellipticity |
|---|---|
| 54 | +0.756 |
| 65.5 | +1 |
| 88 | +1.76 |
| 174 | −1.76 |
| 196.5 | −1 |
| 216 | −0.615 |

Figure 3:
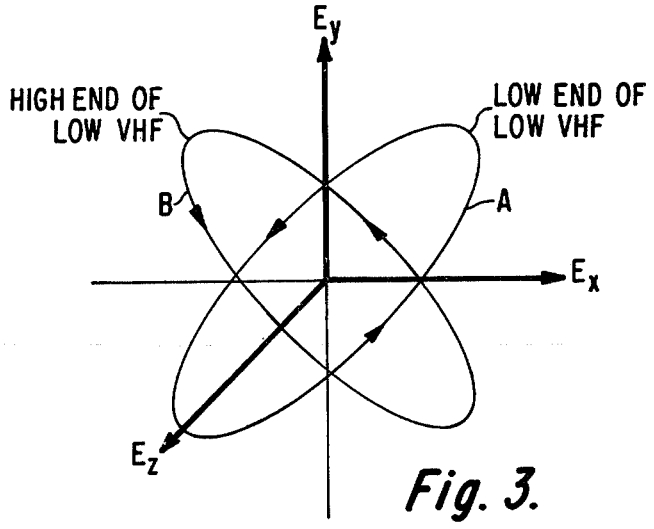
FIG. 3 illustrates the polarization of the waves in the low VHF frequency in accordance with a second embodiment of the present invention.
Figure 4:
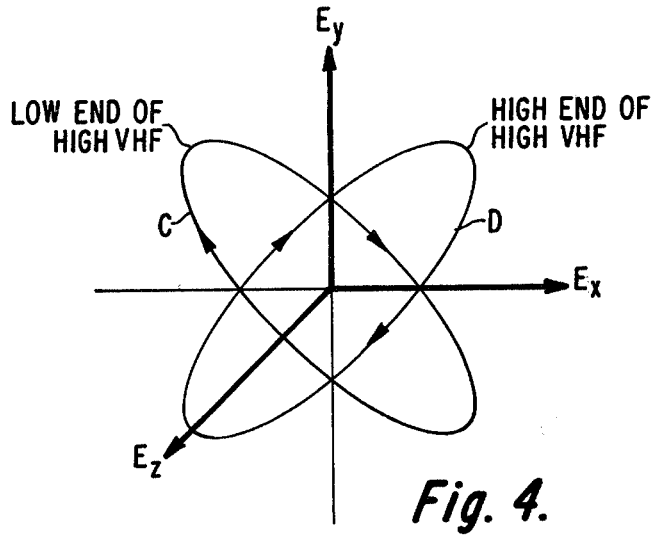
FIG. 4 illustrates the polarization of the high VHF frequency waves in accordance with the second embodiment of the present invention.

At the low end of the low VHF frequency band (below 65.5 MHz) the signal has an ellipse with the major axis in the positive direction as illustrated by ellipse A of FIG. 3 and at the high end of the low VHF frequency (above 65.5 MHz) the ellipse has a major axis in the minus direction as indicated by ellipse B of FIG. 3. Note that the sense of polarization rotation is the same (counter clockwise) in both A and B as viewed at the receiving antenna. At the low end of the high VHF frequency band (below 196.5 MHz), the signal is an ellipse with the major axis in the negative direction as illustrated by ellipse C of FIG. 4 and at the high end of the high VHF frequency band (above 196.5 MHz) the ellipse has a major axis in the positive direction as indicated by ellipse D of FIG. 4. Note that the sense of polarization is clockwise for both C and D as viewed at the receiving antenna.

Figure 5:
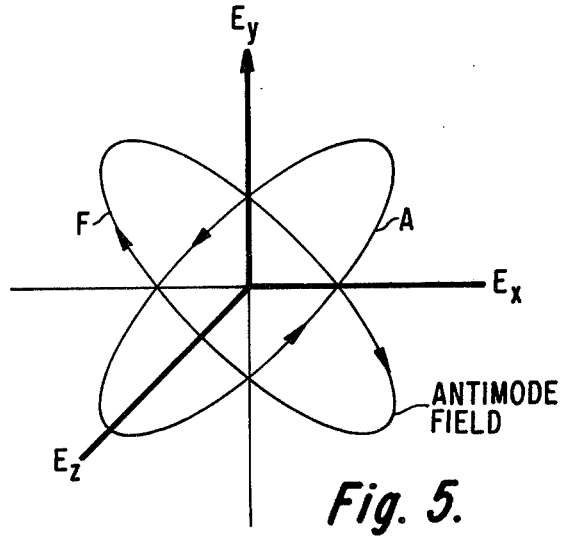
FIG. 5 illustrates the polarization of the reflected wave in accordance with the second embodiment of the present invention.

As stated previously, the reflected circularly waves appear to rotate in the opposite direction with respect to the nonreflected waves. This also takes place with regard to elliptically polarized signals. For example, elliptically polarized signals such as ellipse A in FIG. 5 which would appear normally at the receiving antenna to rotate counterclockwise would appear after reflected in the forward direction as rotating in a clockwise direction and with the major axis oriented in the orthogonal direction as indicated by ellipse F in FIG. 5. Similar rotational reverses and polarizations are associated with the other elliptically polarized signals. Even if the radiated wave is an elliptically polarized wave, this system will be just as effective for "ghosts" resulting from reflections in horizontal and vertical planes as a circularly polarized antenna system.

Figure 6:
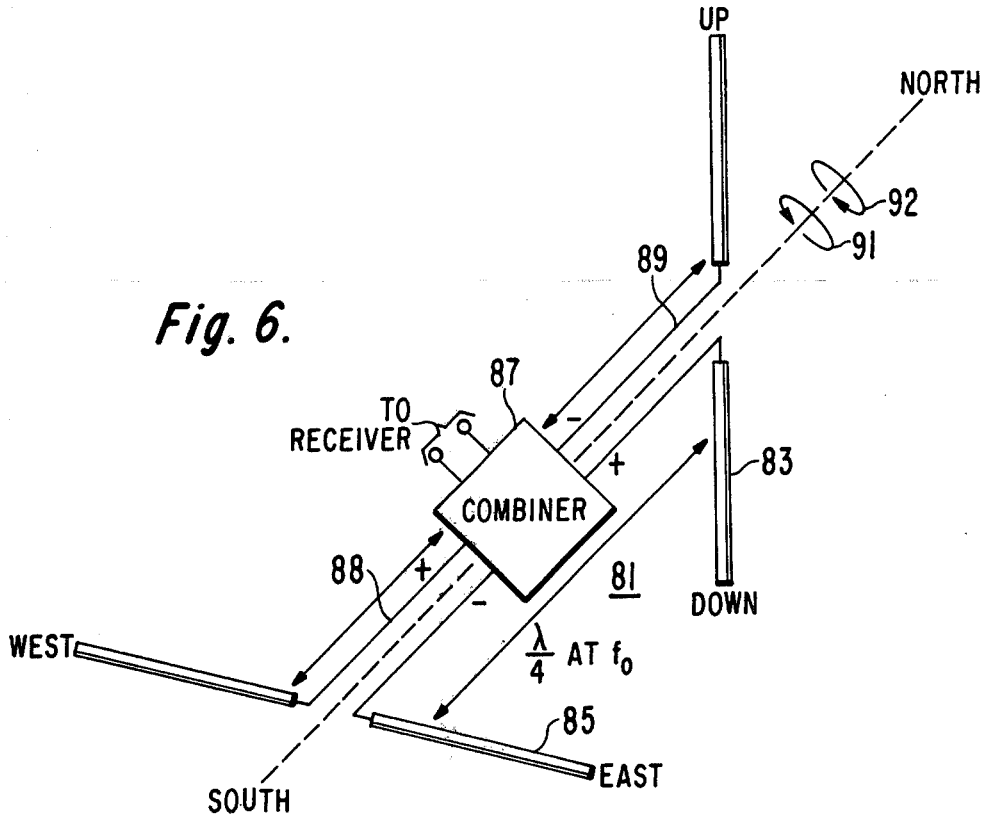
FIG. 6 is a sketch of a receiving antenna according to a further embodiment of the present invention.

Referring to FIG. 6, an alternate approach is described to achieve reception of circularly polarized waves in the system of FIG. 1. In this receiving antenna 81, the vertical dipole 83 is positioned one-quarter wavelength at the low VHF television frequency of 65.5 MHz forward (closer to the transmitting antennas) of the horizontal dipole 85. In this antenna, the one-quarter wavelength delay is accomplished by the spacial separation of the dipoles 83 and 85. The signals are combined with a combiner 87 by equal length transmission lines 88 and 89, where transmission line 88 couples dipole 85 to combiner 87 and transmission line 89 couples dipole 83 to combiner 87. This antenna will pick up a low VHF band field rotating east-up-west-down (indicated by arrow 91) coming from the north (for example the transmitting antennas are to the North of the receiving antenna) but will reject the "ghost" also rotating east-up-west-down coming from the south. This antenna 81 system therefore provides rejection for a reflected circularly polarized signal behind or to the South of the antenna. This antenna system 81 will also reject low VHF signal rotating in the direction of arrow 92 in the same manner as antenna 37. The special separation of dipoles 83 and 85 provides a three-quarter wavelength delay to received signal waves in the high VHF band and therefore this antenna will couple high VHF band signal waves rotating in the direction of arrow 92 from the North (clockwise as viewed at the receiving antenna) to the receiver. The antenna will reject the "ghost" causing signal waves also rotating in the direction of arrow 92 but from the South and high VHF band signal waves rotating in the direction of arrow 91 from the North.

Figure 7:
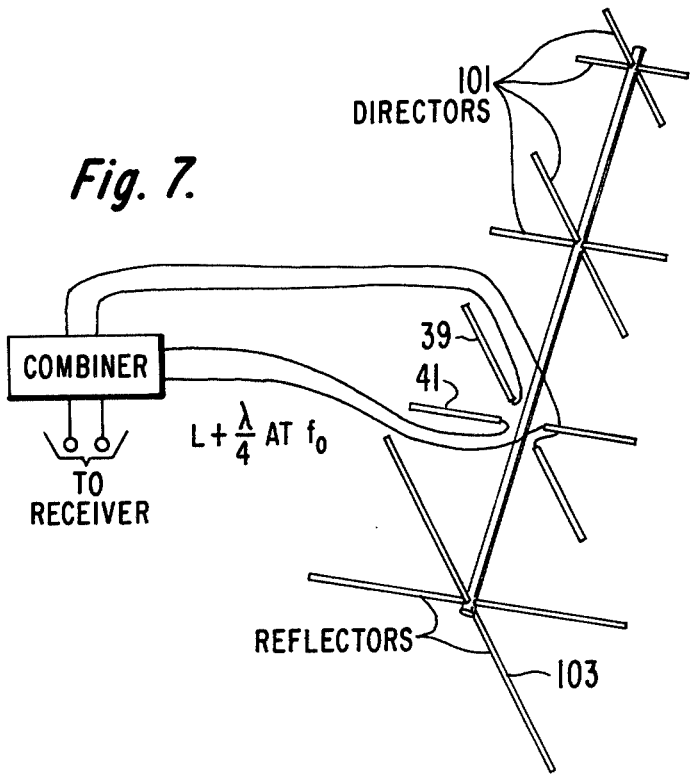
FIG. 7 is a sketch of a yagi antenna system according to a still further embodiment of the present invention.

The above described receiving antennas may be yagi type antennas as illustrated in FIG. 7 wherein, for example, in addition to the crossed dipoles 39 and 41, the receiving antenna may include crossed linear parasitic directors 101 and crossed linear parasitic reflectors 103 with the directors of a slightly shorter length than the dipoles and the reflectors 103 of slightly longer length than the dipoles. The dipoles in FIG. 7 may also be placed as shown in FIG. 6. For higher gain, the receiving antennas may include a plurality of fed dipole elements in two orthogonal planes appropriately spaced from each other and fed in accordance with the teachings of linear receiving antennas. See, for example, VHF portion of Peterson—U.S. Pat. No. 3,653,056.

What is claimed is:

1. A system for communicating signals over two separate frequency bands where the one frequency band contains a frequency approximately three times a frequency in the other frequency band using a common receiving antenna system, comprising:

means for radiating said one frequency band signal waves in a first rotational directional sense over a given area, means for radiating said other frequency band signal waves in a rotational directional sense opposite said first sense, said receiving antenna system located in the common coverage area and directed in the general direction of both of the transmitting antennas comprising a pair of antenna elements each adapted to receive linearly polarized waves with a first of the elements adapted to receive linearly polarized waves in a first linear polarization and the second of the elements adapted to receive linearly polarized waves in a second orthogonal polarization, and means including a delay coupled to said first and second receiving antenna elements for combining said signal waves received at one of said receiving antenna elements with signal waves received at the other of said receiving antenna elements delayed an extra one-quarter wavelength at a frequency within the other lower frequency band and an extra three-quarter wavelengths at a frequency within said one frequency band.

2. The combination of claim 1 wherein said one frequency band is the high VHF television frequency band and the other frequency band is the low VHF television frequency band.

3. The combination of claim 2 wherein said extra delay is one-quarter wavelength at 65.5 MHz.

4. The combination of claim 2 wherein said combining means includes feed lines with the feed line coupled to the other of said antenna elements including an extra section of transmission line one-quarter wavelength long at a frequency in the low VHF television frequency band and three-quarter wavelengths at a frequency in the high VHF television frequency band.

5. A system for communicating television signals over both the low and high VHF television frequency bands to a common television receiver using a common receiving antenna system, comprising:

a plurality of low and high VHF television frequency band broadcast antenna systems, each broadcast antenna system including a pair of orthogonally oriented linear broadcast antenna dipoles adapted to transmit linearly polarized waves, means coupled to each of the low VHF broadcast dipoles for exciting said linear low VHF broadcast dipoles in a phase quadrature at approximately 63–66 MHz, means coupled to the high VHF broadcast dipoles for exciting said high VHF broadcast dipoles in phase quadrature at approximately three times the 63–66 MHz frequencies, said receiving antenna system located in the common coverage area and directed in the general direction of both of the broadcast antenna systems comprising a pair of receiving antenna dipoles adapted to receive linearly polarized waves with a first of the receiving dipoles adapted to receive linearly polarized waves in a first linear polarization and the second of the receiving dipoles adapted to receive linearly polarized waves in a second orthogonal polarization, means coupled to said first and second receiving antenna dipoles and adapted to be coupled to said television receiver for combining said signal waves received at one of said receiving antenna dipoles with signal waves received at the other of said receiving antenna dipoles delayed one-quarter wavelength at approximately 63–66 MHz.

6. A method for receiving rotationally polarized waves over both the low and high VHF television frequency bands where the low VHF television frequency band is transmitted in an opposite rotational directional sense with respect to the high VHF television frequency band comprising:

providing a pair of dipole antennas and a signal wave combiner with one of the dipole antennas adapted to receive linearly polarized waves in a first linear polarization at the low VHF television frequency band and the other of the dipole antennas adapted to receive linearly polarized waves in a second orthogonal polarization at the low VHF television frequency band, and coupling the received first linearly polarized waves to the combiner over a given electrical length L and coupling the second linearly polarized waves to a combiner over an electrical length of $L+(\lambda/4)$ where $\lambda$ is a wavelength at a frequency in the low VHF television frequency band whereby said second waves in the low VHF band undergo approximately an additional 90° phase shift and said second waves in the high VHF band undergo approximately an additional 270° phase shift.

7. The combination claimed in claim 6 wherein $\lambda$ is a wavelength at about 65.5 MHz.

* * * * *